US009968842B2

(12) United States Patent
Fischer et al.

(10) Patent No.: US 9,968,842 B2
(45) Date of Patent: May 15, 2018

(54) LASER TAG BOW

(71) Applicant: Laser Tag Pro, Inc., Greenfield, WI (US)

(72) Inventors: Aaron Fischer, Greenfield, WI (US); Zachary Dickerson, Greenfield, WI (US)

(73) Assignee: Laser Tag Pro, Inc., Greenfield, WI (US)

( * ) Notice: Subject to any disclaimer, the term of this patent is extended or adjusted under 35 U.S.C. 154(b) by 172 days.

(21) Appl. No.: 15/192,526

(22) Filed: Jun. 24, 2016

(65) Prior Publication Data

US 2016/0339335 A1 Nov. 24, 2016

Related U.S. Application Data

(60) Provisional application No. 62/165,011, filed on May 21, 2015.

(51) Int. Cl.

| | |
|---|---|
| ***A63F 9/02*** | (2006.01) |
| ***F41A 33/02*** | (2006.01) |
| ***A63F 9/24*** | (2006.01) |
| ***F41B 5/00*** | (2006.01) |

(52) U.S. Cl.

CPC ..... *A63F 9/0252* (2013.01); *A63F 9/0291* (2013.01); *A63F 9/24* (2013.01); *F41A 33/02* (2013.01); *F41B 5/0094* (2013.01); *A63F 2009/0269* (2013.01); *A63F 2009/2444* (2013.01); *A63F 2250/495* (2013.01)

(58) Field of Classification Search

CPC .. A63F 9/0252; A63F 9/24; A63F 2009/2444; A63F 2009/0269; F41A 33/02

See application file for complete search history.

(56) References Cited

U.S. PATENT DOCUMENTS 5,247,920 A * 9/1993 Harbin ..... A63F 9/0252 124/17
5,332,120 A * 7/1994 D'Andrade ..... B05B 9/0426 222/401
5,741,185 A * 4/1998 Kwan ..... A63F 9/0291 434/22

(Continued)

FOREIGN PATENT DOCUMENTS

WO 2015020608 A1 2/2015

*Primary Examiner* — Jay Liddle

(74) *Attorney, Agent, or Firm* — Kevin Keener; Keener and Associates P.C.

(57) ABSTRACT

A gaming device for use in a laser tag game comprising a bow shaped body, a string coupled to a pair of arms, and an infrared emitter coupled to the bow shaped body. The infrared emitter is configured to generate an infrared beam when the string is pulled away from the bow shaped body and returned to its original static position. The device may further comprise omnidirectional infrared receivers, flex sensors, lights, speakers, or vibration motors. In other embodiments the gaming device may further comprise a battery, a charging, one or more trigger buttons, one or more control buttons, a display screen, microprocessors, and a wireless transceiver. In other embodiments the infrared emitter comprises a lens and an infrared LED. In other embodiments the gaming device may further comprise a quiver device configured to permit a user to reload shots during the game.

57 Claims, 16 Drawing Sheets

(56) References Cited

U.S. PATENT DOCUMENTS

D437,358 S * 2/2001 Watson ..... D21/328
6,302,796 B1 * 10/2001 Lebensfeld ..... A63F 9/0291 446/175
7,306,523 B1 * 12/2007 Jeffway, Jr. ..... F41A 33/02 446/175
7,632,187 B1 * 12/2009 Farley ..... A63F 9/02 434/11
8,303,421 B1 * 11/2012 Farley ..... A63F 9/02 434/11
8,439,720 B2 * 5/2013 Inoue ..... A63F 9/0291 434/11
8,469,824 B1 * 6/2013 Farley ..... F41J 5/02 434/11
8,951,128 B1 * 2/2015 Farley ..... F41J 5/02 434/11
9,067,127 B2 6/2015 Clark
9,633,573 B1 * 4/2017 Tafoya ..... G09B 19/0038
2003/0027612 A1 * 2/2003 Watanabe ..... F41A 33/02 463/2
2003/0027613 A1 * 2/2003 Hasebe ..... F41A 33/02 463/2
2003/0027640 A1 * 2/2003 Jeffway, Jr. ..... F41A 33/02 463/49
2004/0014010 A1 * 1/2004 Swensen ..... F41A 33/02 434/21
2011/0207512 A1 * 8/2011 Wang ..... A63F 13/245 3/245
2013/0130760 A1 * 5/2013 Jensen ..... F41A 33/02 463/5
2013/0184085 A1 * 7/2013 Clark ..... A63F 9/0291 463/56
2014/0199913 A1 * 7/2014 Rosenblum ..... F41A 33/02 446/473
2016/0184698 A1 * 6/2016 Tan ..... A63F 13/216 463/2

* cited by examiner

LASER TAG BOW

PRIORITY

This application claims priority to U.S. provisional patent application No. 62/165,011, filed May 21, 2015, which is hereby fully incorporated by reference.

FIELD OF INVENTION

This invention pertains generally to laser tag gaming systems and more particularly to a laser tag bow, a receiver, an electronic quiver system, and a method of use.

BACKGROUND OF INVENTION

Laser tag is a very popular game and is known in the prior art. Historically, a laser tag system has utilized multiple firearm-like devices or "guns". The guns incorporate an infrared emitter and an infrared receptor. The infrared receptor may be incorporated into the gun or within a separate device connected to the gun through a wire or wireless means. Normally the infrared receptor is worn as a separate device on a player's chest or arm. A player aims his gun at another player and pulls the trigger. The trigger activates the infrared emitter on the gun. The infrared signal travels toward the infrared receptor worn by the other player. If the infrared signal activates the infrared receptor then a signaling means is activated. The signaling means is intended to inform the player that the player has been "hit." The signaling means is normally a vibration, a flashing light, or an audible sound. Optionally, a player's gun may become deactivated when the player is hit.

Historically laser tag systems have solely utilized gun type emitters. The emitters are gun shaped and have a trigger which a user must pull to engage the emitter. These type of emitters provide a single type of game play—the player pretends to shoot a gun. What is needed is an additional type of weaponry which may be utilized in laser tag game play permitting an expansion on the type of game play and interaction between the players.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed toward a gaming device for use in a laser tag game comprising a bow shaped body having a first arm and a second arm, a string having a first end coupled to the first arm and a second end coupled to the second arm, an infrared emitter coupled to the bow shaped body, wherein the infrared emitter is configured to generate an infrared beam when the string is pulled away from the bow shaped body and returned to its original static position. The device may further comprise one or more omnidirectional infrared receivers, one or more flex sensors disposed in the first arm and/or the second arm, one or more lights, one or more speakers, or one or more vibration motors. In other embodiments the gaming device may further comprise a battery, a charging port disposed in the bow shaped body, one or more trigger buttons configured to signal the infrared emitter to generate an infrared beam when pressed, one or more control buttons configured to adjust the operation of the gaming device when pressed, one or more display screens, one or more microprocessors, or one or more wireless transceivers. In other embodiments the infrared emitter comprises a lens and an infrared LED. In other embodiments the gaming device may further comprise a tube having a length with a first end, a second end, and a longitudinal axis. The longitudinal axis of the tube is substantially perpendicular to the string and the first end of the tube is connected to the infrared emitter. In other embodiments the gaming device further comprises a finger guide disposed on the string.

In other embodiments of the laser bow the tube has an internal cavity. The gaming device may further comprise a slide disposed within the internal cavity of the tube and an internal trigger button disposed within the internal cavity of the tube. In this embodiment the internal trigger button is configured to signal the infrared emitter to generate an infrared beam when activated by the slide. In a separate embodiment the gaming device further comprises a slide containing one or more magnets disposed within the internal cavity of the tube and one or more internal magnetic sensors disposed within the internal cavity of the tube. In this embodiment the magnetic sensors are configured to signal the infrared emitter to generate an infrared beam when activated by the magnets in the slide.

In another embodiment the gaming device further comprises one or more piezoelectric sensors disposed on the first arm and/or the second arm. Alternatively, the gaming device further comprises a first wheel rotably connected to an end of the first arm and a second wheel rotably connected to an end of the second arm. The string is coupled to the first wheel and the second wheel. The first wheel and the second wheel are configured to signal the infrared emitter to generate an infrared beam when rotated by the string.

In another embodiment the gaming device further comprises a quiver communicatively coupled to the gaming device. The quiver is configured to send a reload signal to the gaming device when the reload lever is pulled. The quiver may comprise one or more reload levers, one or more straps, one or more lights, a battery, a charging port, one or more microprocessors, one or more omnidirectional infrared receivers, and one or more transceivers. In another embodiment the quiver further comprises an internal cavity and a magnetic sensor disposed adjacent to the internal cavity. The reload lever is disposed in the internal cavity and the reload lever further comprises a magnet. In another embodiment the quiver further comprises an internal cavity and a reload button disposed in the internal cavity. The reload lever is disposed in the internal cavity and the reload lever further comprises a flange.

The invention is also directed toward a method for playing a laser tag game comprising holding a hand-held gaming device, grasping the string in a first static position where the string is disposed adjacent to the bow shaped body, pulling a portion of the string away from the first static position to a second position where the portion of the string is disposed further away from the bow shaped body than when in the first static position, returning the string to the first static position, and generating and emitting an infrared beam from the infrared emitter. The hand-held gaming device utilized in the method comprises a bow shaped body having a first arm and a second arm, a string having a first end coupled to the first arm and a second end coupled to the second arm, an infrared emitter coupled to the bow shaped body, and a means for generating an infrared beam from the infrared emitter when the string is pulled away from the bow shaped body and returned to its original static position.

In another method of the invention the gaming device further comprises a quiver communicatively coupled to the gaming device and comprising one or more reload levers and a means for generating and sending a reload signal to the gaming device when the reload lever is pulled. In this embodiment the method further comprises pulling the reload lever from a first static position to a second position, generating, by the quiver, a reload signal, transmitting the reload signal to the hand-held gaming device, and altering a game play function when the hand-held gaming device receives the reload signal.

The method may further comprise determining an amount of displacement of the portion of string from the first static position to the second position and altering a game play function or game play attribute based on the amount of displacement of the portion of string.

The method may further comprise receiving the infrared beam by an omnidirectional infrared receiver utilized by a second player. The method may further comprise altering a game play function or game play attribute when the infrared beam is received by the omnidirectional receiver utilized by a second player.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

As used in this application, the terms "component", "module", "system", "interface", or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component.

The invention comprises a laser tag bow and a quiver system. The laser tag bow comprises a bow shaped body, a draw string, an infrared emitter, an infrared receiver, and one or more flex sensors. The user draws the draw string, which causes a bending of the flex sensor. When the flex sensor returns to the first position a signal is sent to the infrared emitter. The infrared emitter emits an infrared beam. The infrared beam hits a receiver worn by another player. The receiver may also be attached to the bow or to the quiver system. The quiver can be communicatively coupled to the laser tag bow. The quiver has a reload lever. When in a game, the player may have a limited number of shots. To reload the number of shots the player has to pull on the reload lever, which simulates a player pulling an arrow from a quiver. The reload may be triggered by any number of means, such as by flipping a physical switch or a magnetic switch.

The system may further comprise an infrared receiver to which can be hit by other players when they shoot an infrared beam at the player. In another embodiment the degree which the flex sensor bends determines the amount of damage experienced by the player hit with the shot. The degree of damage done by the bow can be signaled by a series of LED lights on the laser tag bow. The more the draw string is drawn back the more lights that are enlightened.

Figure 1:
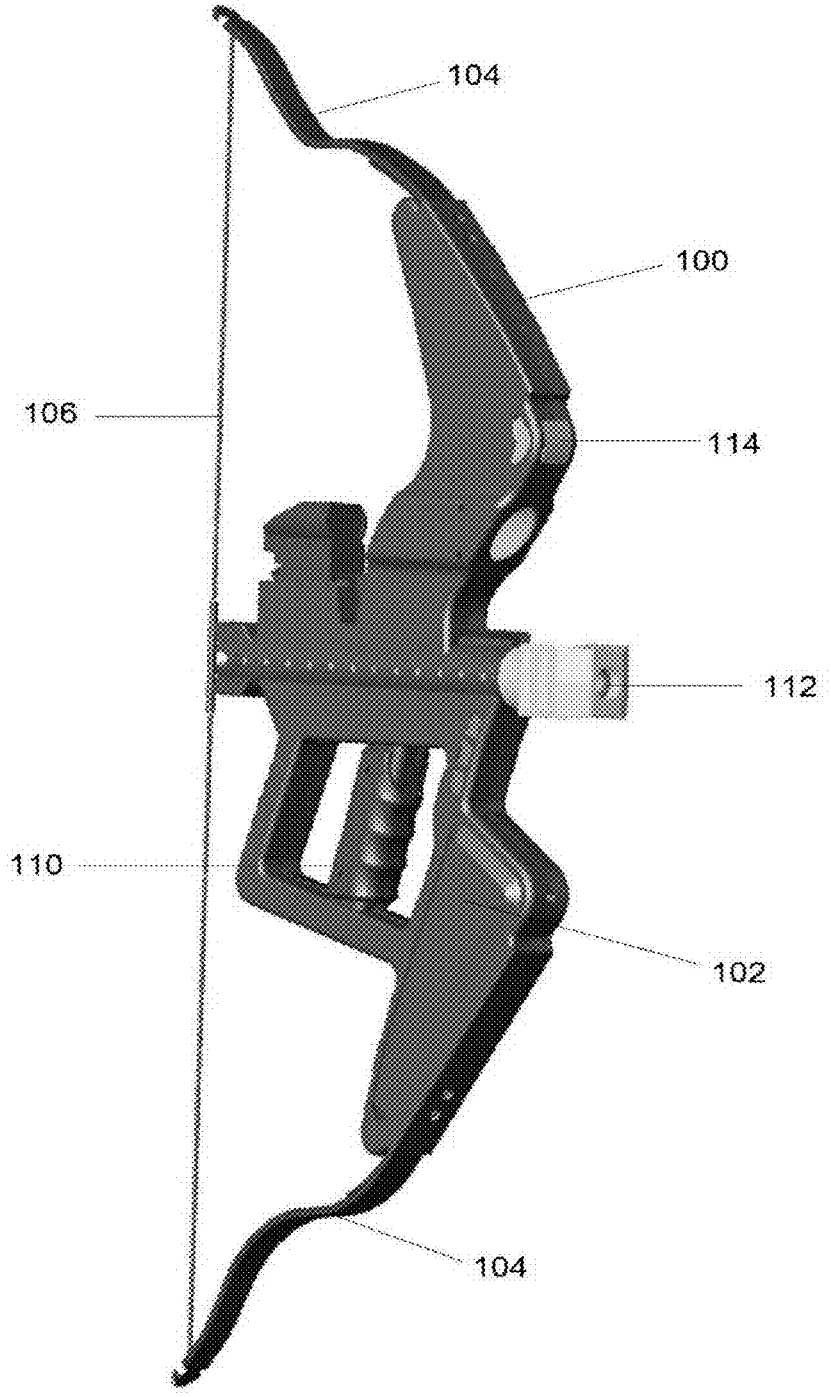
FIG. 1 is a front perspective view of a laser bow.
Figure 2A:
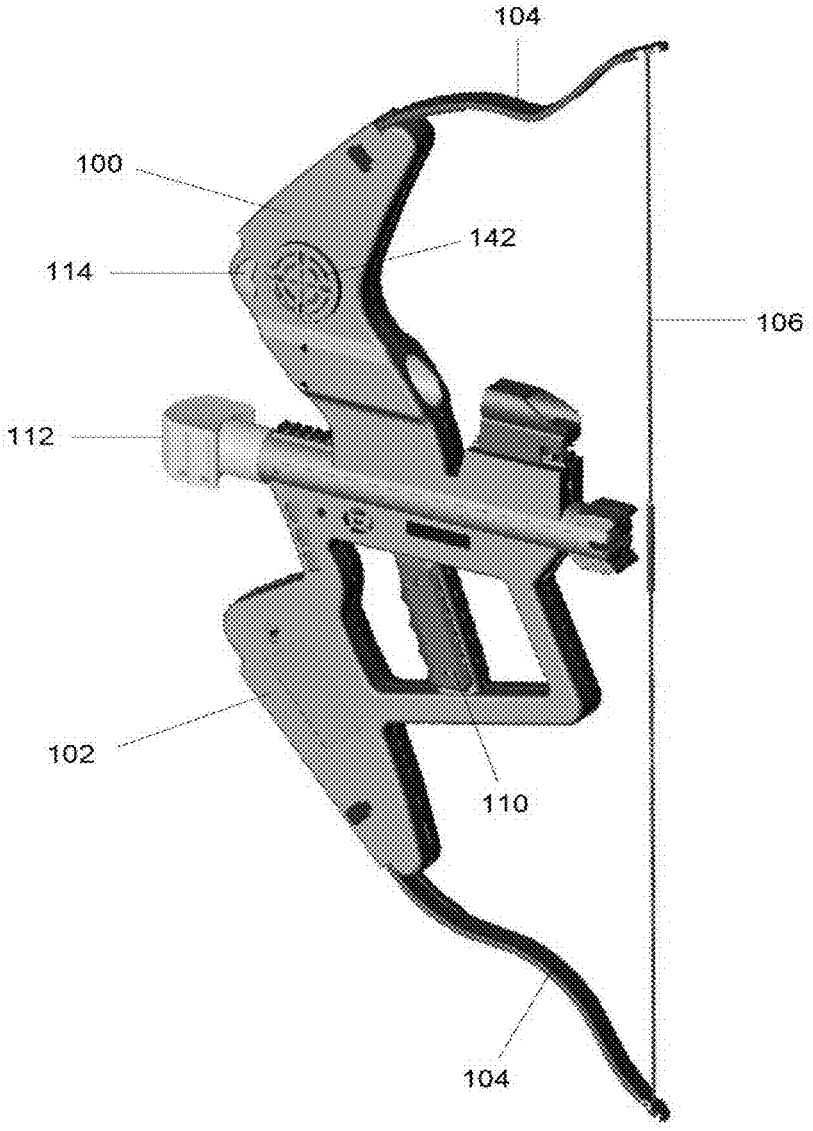
FIG. 2A is a rear perspective view of a laser bow.
Figure 2B:
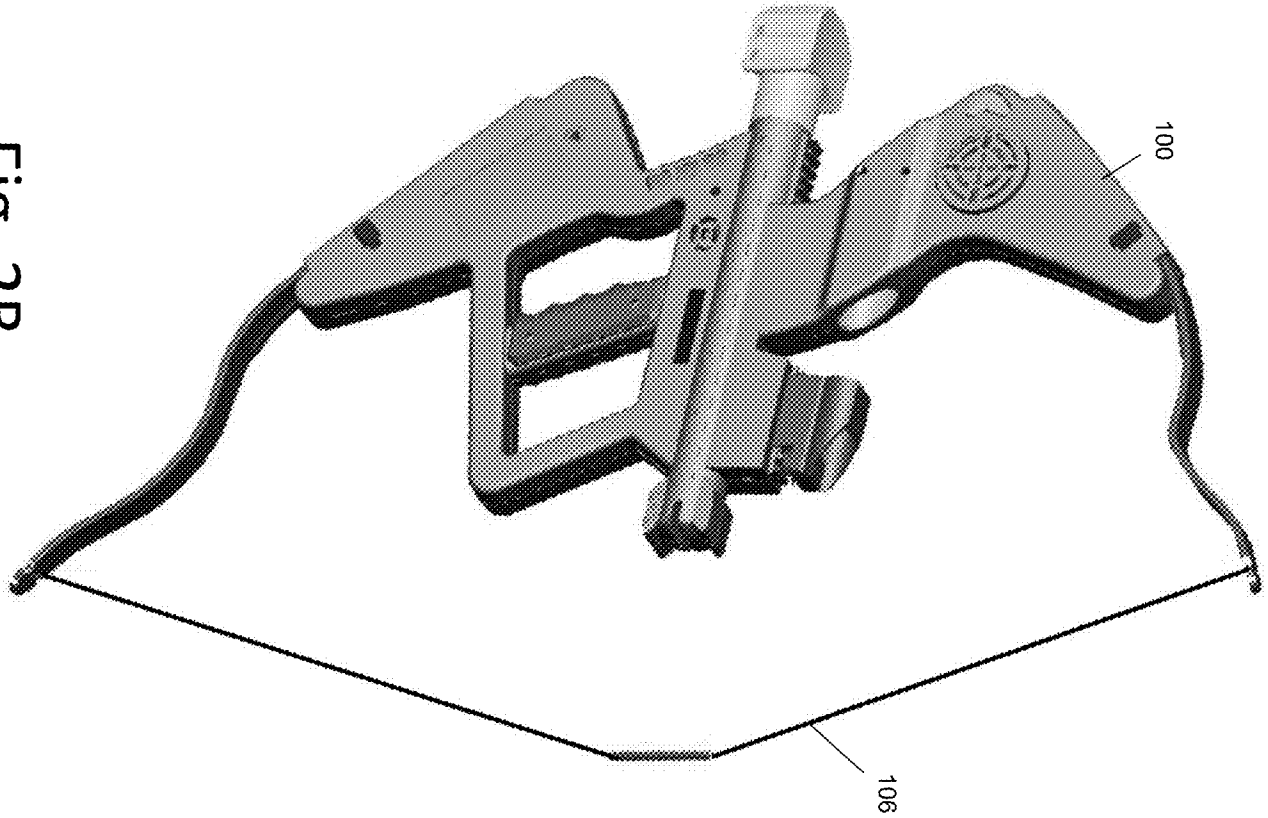
FIG. 2B is a rear perspective view of a laser bow.
Figure 3:
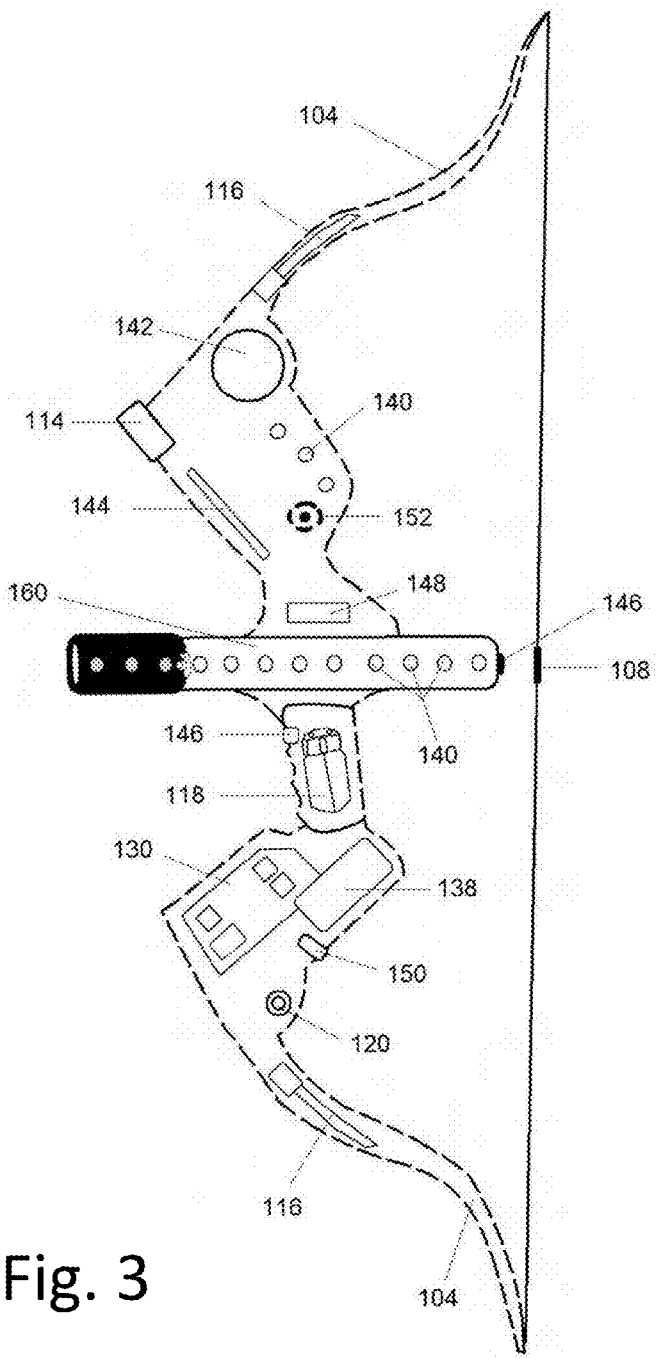
FIG. 3 is a side cut away view of a laser bow.

Referring to FIG. 1 through FIG. 3, the preferred embodiment of the laser bow 100 is displayed. The laser bow 100 comprises a bow shaped body 102 with a pair of flexible arms 104 disposed from the top of the body 102 and the bottom of the body 102. Attached to the pair of flexible arms 104 is a draw string 106. A user can pull on the finger guide 108 disposed on the draw string 106, pulling the draw string 106 away from the body 102 and flexing the flexible arms 104. The user can hold the laser bow 100 in one hand with the handle 110 disposed within the body 102 of the laser bow 100.

The laser bow 100 operates nearly identical to a laser tag gun. The laser bow 100 has an infrared emitter 112 and one or more omnidirectional infrared receivers 114. The infrared emitter 112 emits an infrared beam. The user can shoot the infrared beam toward other users. If the other user's device detects the infrared beam with an infrared receiver, the other user will be registered as "hit." Likewise, if the omnidirectional infrared receiver 114 detects the infrared beam shot from the gun of another user, the user is deemed "hit" by the other user.

In the preferred embodiment, the user of the laser bow 100 shoots by drawing on the draw string 106 and pulling the drawstring into an extended position away from the body of the laser bow 100 as shown in FIG. 2B. Pulling on the draw string bends the flexible arms 104 of the body 102. Disposed within each of the flexible arms 104 is a flex sensor 116. When the flex sensor 116 flexes, the flex sensor may be configured to send an electronic signal to the infrared emitter 112 to emit an infrared beam. In the preferred embodiment the flex sensor 116 is a flexible longitudinal device which may flex and bend. In this embodiment, the electrical resistance of the flex sensor 116 changes as it flexes. A current is passed substantially constantly through the flex sensor 116 and when an increase in the resistance, followed by a return to the original resistance, the printed circuit board 130 determines that the flex sensor 116 has sufficiently flexed to indicate that a user has pulled the string 106 to a pulled position and released the string 106. The printed circuit board 130 then signals for the infrared emitter 112 to emit an infrared beam.

Any time that the laser bow 100 makes a shot from the infrared emitter 112 or detects a hit by the omnidirectional infrared detector 114, the laser bow can emit a sound via a speaker 142. Anytime that the laser bow 100 detects a hit, the laser bow 100 can vibrate via one or more vibration motors 118 disposed in the body 102. The vibration motor 118 can be disposed anywhere in the body 102. In the preferred embodiment the vibration motor 118 is disposed in the handle 110 of the laser bow 100.

As displayed in FIG. 3, the separate internal components of the laser bow 100 are displayed. The laser bow 100 can be turned on and off via a power button 120. Power is provided to the laser bow 100 by a battery 138 house within the body 102 of the laser bow 100. The battery 138 may be recharged via a charging port 150. The functions of the laser bow 100 are controlled by a printed circuit board 130. The laser bow 100 has a plurality of addressable LEDs 140. The LEDs 140 may light up at any time and in any pattern. The LEDs 140 may be used to signal the amount of a user's life left during a game, when a user is hit, or when a user makes a shot.

The laser bow 100 utilizes an antenna 144, allowing the laser bow 100 to communicate with a remote computer, a server, other game components such as the quiver 200, other player's guns, bows, or quivers, a cellular device, a wireless network, a LAN, or any other communication network or device. The laser bow 100 may make use of one or more trigger buttons 146. One trigger button 146 is disposed on the handle 110. Another trigger button 146 may is disposed on the rear of the tube 160. The user may push the trigger button 146 to generate an infrared beam as a shot from the infrared emitter 112 instead of using the draw string 106. Alternatively, the finger guide 108 on the draw string 106 may contact the trigger button 146 on the rear of the tube 160 on recoil to emit a shot.

The laser bow 100 may also utilize a display screen 148. The display screen 148 may be any type of display, such as touch screen display or LCD display. The display screen 148 can display information about the game being played or other game attributes, such as player health, number of lives remaining, shots taken, shots remaining, other player's information, or any other game relevant information. The operations of the laser bow 100 may be further controlled through a plurality of control buttons 152. The control buttons 152 may be used to change the settings or functionality of any component of the laser bow 100.

The laser bow 100 may also utilize a tube 160 disposed in the center of the body 102. The tube 160 can be used to house the components of the infrared emitter 112 which generate the infrared beam. The tube may have a plurality of LEDs 140 disposed along the length of the tube 160. The LEDs 140 on the tube may be configured to light up in a specific configuration depending on the amount that the draw string is pulled. For instance, if the draw string 106 is pulled only a little, then the LEDs 140 closest to the infrared emitter 112 would light up. As the draw string 106 is pulled more, then more LEDs 140 on the tube 160 light up. When the draw string 106 is at its maximum displacement, all of the LEDs 140 on the tube 160 light up. The tube 160 may be any size, shape, and dimension. In other embodiments, the laser bow 100 may not utilize a tube 160.

Figure 4:
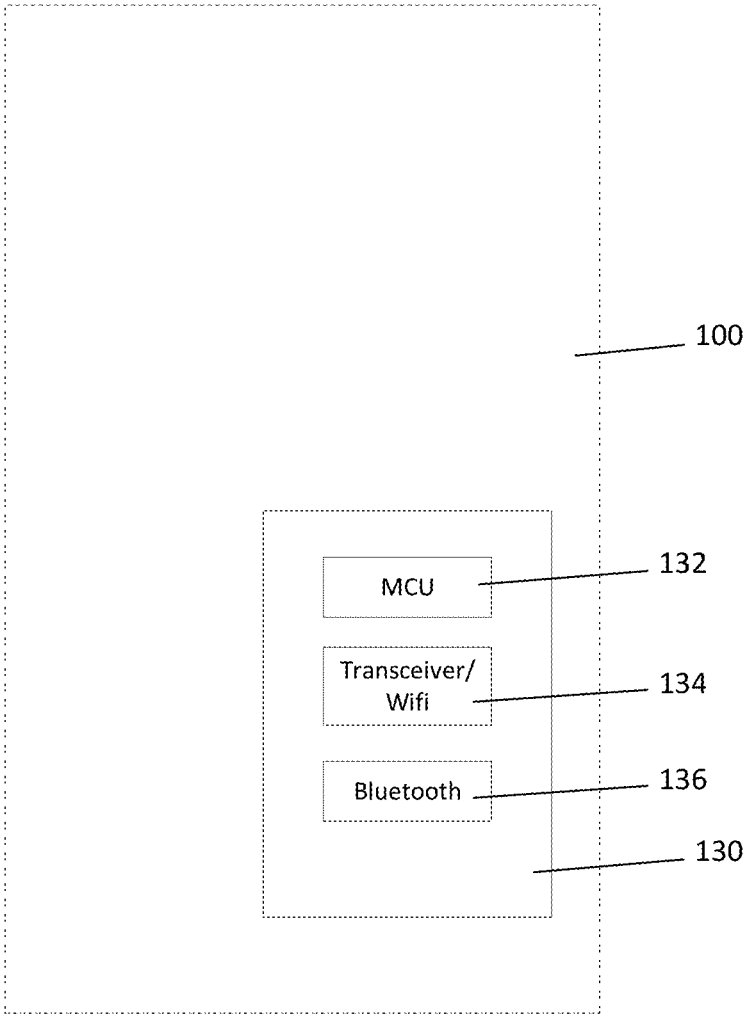
FIG. 4 is a schematic of the electronic board of a laser bow.

Referring to FIG. 4, the components of the printed circuit board 130 disposed in the laser bow 100 are displayed. The printed circuit board 130 may have any number of components or circuits and may store data and executable instructions. In the preferred embodiment, the printed circuit board 130 has a microprocessor 132, a transceiver 134, and a Bluetooth transmitter 136. The microprocessor 132 is configured to execute instructions and control the total electronic operations of the laser bow 100. The transceiver 134 permits the laser bow 100 to communicate with other devices. The transceiver 134 can operate via a WiFi signal, Near Field Communication, or any other communication means. The Bluetooth transmitter 136 permits the laser bow 100 to communicate with any other Bluetooth enabled device, such as a cellular phone.

Figure 5A:
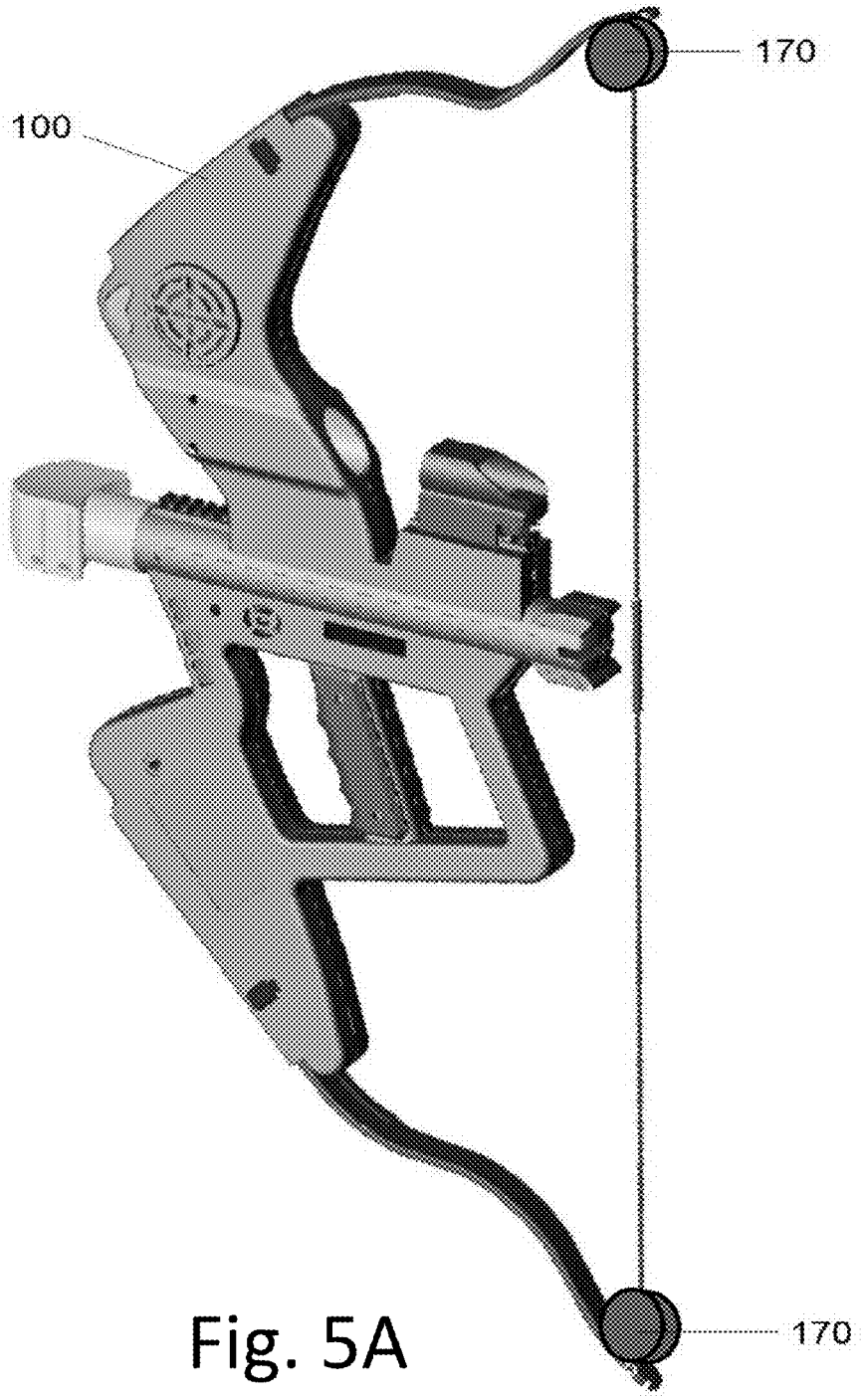
FIG. 5A is a rear perspective view of an alternative embodiment of the laser bow.

Referring to FIG. 5A, an alternative embodiment of the laser bow 100 is displayed. In this embodiment the laser bow 100 further comprises a pair of wheels 170 disposed at the ends of the flexible arms 104. The draw string 106 is wrapped around the wheels 170 same as a compound style bow. In this embodiment, the laser bow 100 may not have flex sensors 116. In this embodiment the turning and release of the wheels 170 causes the printed circuit board 130 to send a signal to the infrared emitter 112. The infrared emitter 112 then generates and shoots an infrared beam.

Figure 5B:
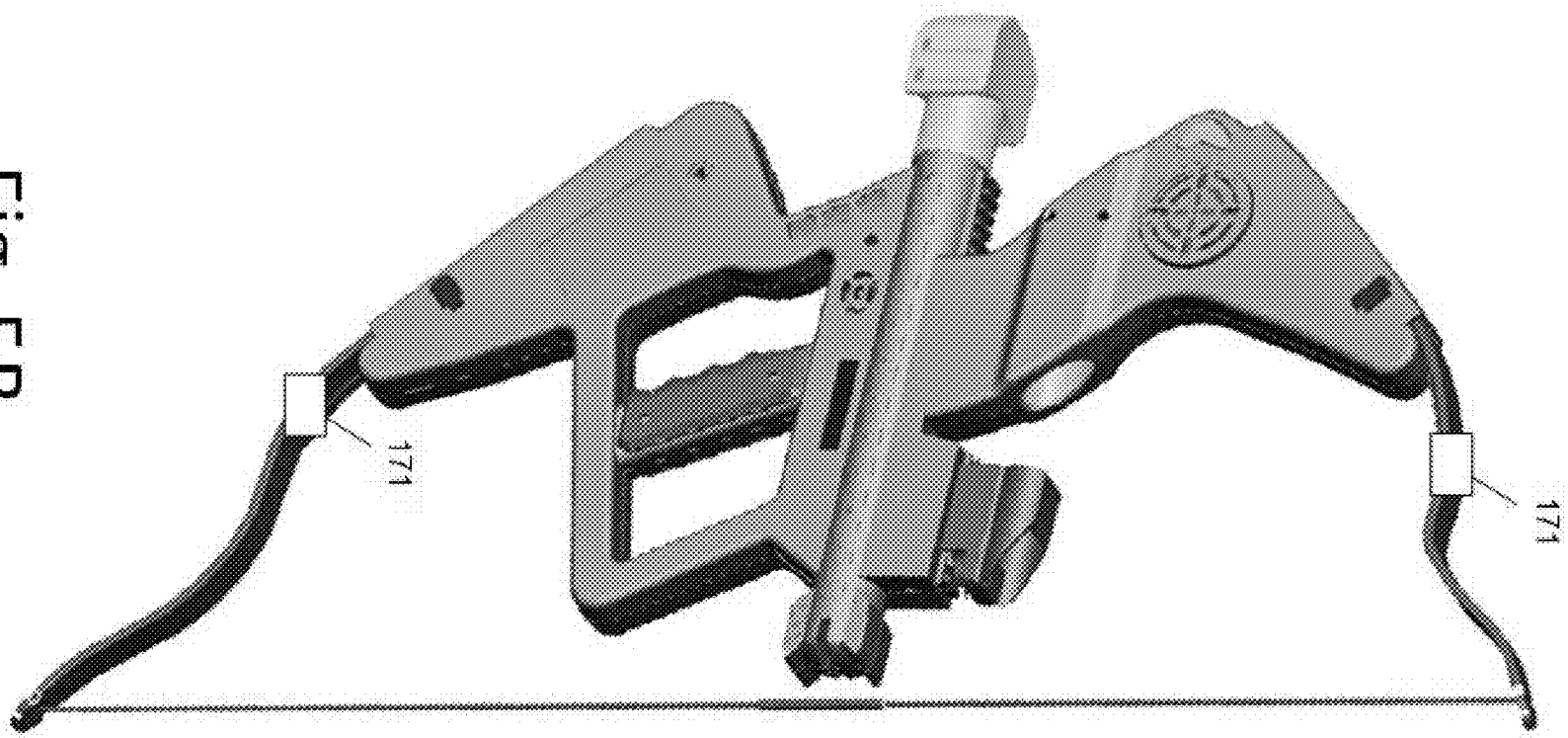
FIG. 5B is a rear perspective view of an alternative embodiment of the laser bow.

Referring to FIG. 5B, an alternative embodiment of the laser bow 100 is displayed. In this embodiment the laser bow further comprises one or more portions of piezoelectric film 171 disposed on the body of the laser bow 100. In the preferred embodiment the one or more portions of piezoelectric film 171 are disposed on the surface of the flexible arms 104. Alternatively the piezoelectric film 171 can be disposed within the flexible arms 104 or adjacent to the flexible arms. As a user pulls back on the draw string 106, the piezoelectric film 171 deforms. This deformation causes the piezoelectric film 171 to create an electrical impulse which is received and processed by the printed circuit board 130. When the printed circuit board 130 detects the electrical impulse, the printed circuit board 130 sends a signal to the infrared emitter 112 and the infrared emitter generates and emits an infrared beam.

Figure 6:
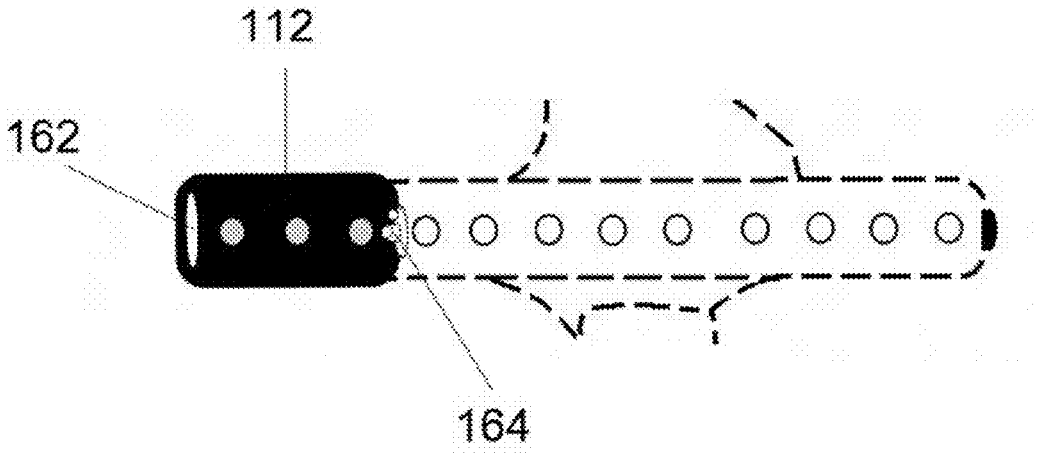
FIG. 6 is a side cut away view of the tube of the laser bow.

Referring to FIG. 6, the components of the infrared emitter 112 are displayed. The infrared emitter 112 comprises a lens 162 and an infrared laser 164. The lens 162 may be any size and shape. The lens 162 may redirect or focus the infrared beam or let the infrared beam pass through without diffracting or diffusing the beam. The infrared laser 164 may be any type of light, bulb, LED, diode, or other component configured to generate an infrared beam. The infrared laser 164 may be configured to emit an infrared beam encoded with game information. For instance, the infrared beam may be emitted as a data stream to identify the identity of the player who shot the bow, the power of the shot, the amount of health to be lost by the player who is hit by the infrared beam, or any other relevant game information.

Figure 7:
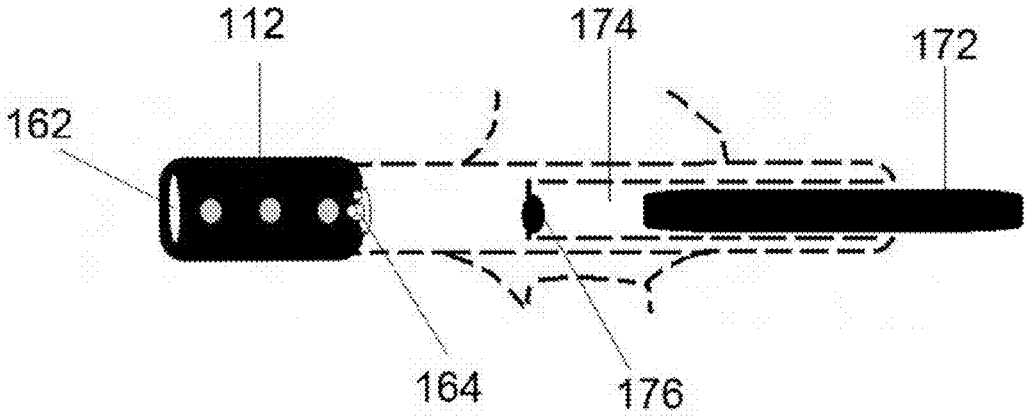
FIG. 7 is a side cut away view of the tube an alternative embodiment of the laser bow.

Referring to FIG. 7, an alternative embodiment of the tube 160 is displayed. In this embodiment the tube 160 has an internal cavity 174. Instead of having a trigger button 146 placed on the rear of the tube 160, the tube 160 has a piston 172 extending through the internal cavity 174. The piston 172 moves forward and backward freely through the internal cavity 174. In the innermost portion of the internal cavity 174 has an internal trigger button 176 which sends a signal for the infrared emitter 112 to emit an infrared beam when pressed by the piston 172. To fire a shot the user pulls back on the piston 172 and presses the piston 172 in against the internal trigger button 176. In one embodiment the piston 172 may be attached to an internal spring within the internal cavity 174 so that the piston 172 automatically recoils into the internal cavity 174 and presses the internal trigger button 176 to generate a shot from the infrared emitter 112. In another embodiment the end of the piston 172 is attached to the draw string 106. In this embodiment, the piston 172 is withdrawn from the internal cavity 174 when the user pulls back on the draw string 106. As the draw string 106 returns to its original position, the draw string pushes the piston 172 back into the internal cavity 174 and the piston 172 presses against the internal trigger button 176 to generate a shot from the infrared emitter 112. In this embodiment there may be multiple internal trigger buttons 176 disposed through the internal cavity 174 so that the laser bow 100 can determine the amount of displacement of the piston 172. The laser bow 100 can be configured so that the greater the displacement of the piston 172, the greater amount of damage the resulting infrared beam generated by the infrared emitter 112 will do the player hit by the shot.

Figure 8:
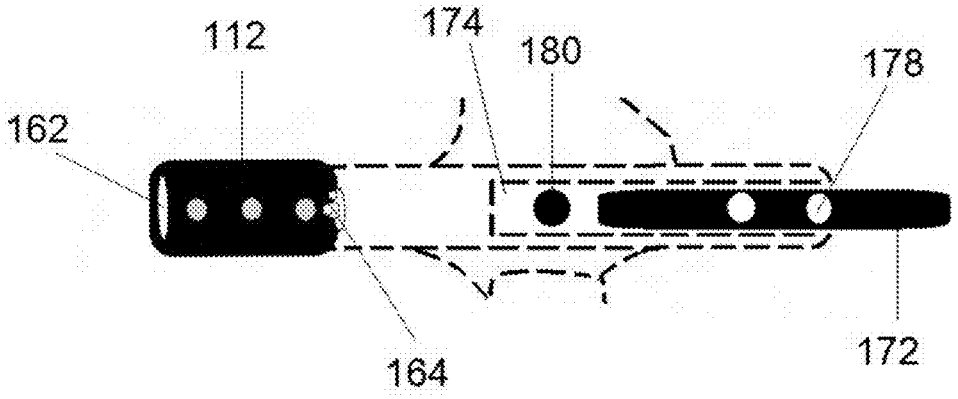
FIG. 8 is a side cut away view of the tube an alternative embodiment of the laser bow.

Referring to FIG. 8, an alternative embodiment of the tube 160 is displayed. In this embodiment the piston 172 has one or more piston magnets 178. In addition, the internal cavity 174 of the tube 160 has one or more magnetic sensors 180. The magnetic sensors 180 detect the passing of the piston magnets 178 to sense displacement of the piston 172 within the internal cavity 174. When the magnetic sensors 180 detect the backward motion of the piston 172 and the return of the piston 172 to its original position, the magnetic sensors 180 send a signal to the infrared emitter 112 to emit an infrared beam. In addition, the magnetic sensors 180 can be configured to determine the amount of displacement of the piston 172 and notify the infrared emitter 112 to alter the damage done by the infrared beam. The piston 172 in this embodiment may be attached to the draw string 106 or to an internal spring to cause the piston 172 to return to its original position fully within the internal cavity 174 when released by the user.

Figure 9:
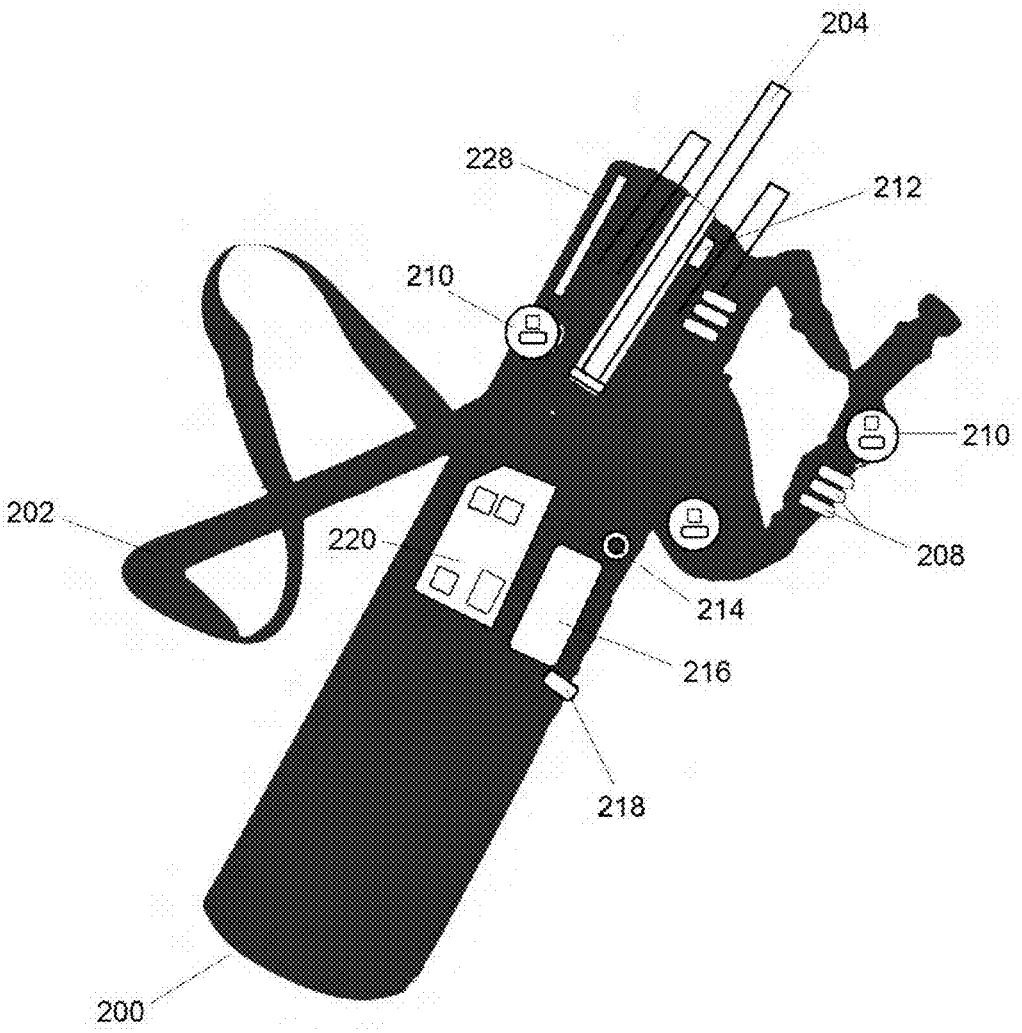
FIG. 9 is a side view of a quiver for the laser bow.

Referring to FIG. 9, the laser bow 100 may be paired with an electronic quiver 200. The quiver 200 enhances the game play of the laser bow 100. The laser bow 100 may have a limited number of shots that a user can make during game play before reloading. The user may be able to use the laser bow 100 without the quiver 200. If a user runs out of shots then the user may have to press a trigger button 146 or a control button 152 to reload the number of shots that the user can take with the laser bow 100. Alternatively, the user may use the quiver 200. The quiver 200 can be communicatively coupled to the laser bow 100 through a wired or a wireless connection. When a user runs out of shots on the laser bow 100 the user can pull on the reload lever 204 to reload the number of shots the user can take with the laser bow 100. The user pulls the reload lever 204 outward, simulating pulling an arrow from a quiver. When the reload lever 204 is pulled upward a sufficient amount, the quiver 200 sends a signal to the laser bow 100 that the number of shots available to the user is reset to a predetermined number.

The quiver 200 may be available in several different embodiments. The preferred embodiment of the quiver 200 will be described. The quiver 200 has one or more straps 202 attached to the body of the quiver 200. The straps 200 may be any size and shape and may be adjustable. The straps 202 are configured to allow a user to wear the quiver 200 over one arm or as a backpack. The quiver 200 has a plurality of addressable LEDs 208. The LEDs 208 may enlighten when a user is hit by the infrared beam of another user. In another embodiment the quiver 200 also has a vibration motor (not shown) to cause the quiver to vibrate when the user is hit. The quiver has one or more omnidirectional infrared receivers 210 to detect infrared beams shot by other players. The quiver 200 has a power switch 214 to turn the power on an off on the quiver 200. The quiver 200 has a battery 216 to provide power to the quiver 200 and a charging port 218 used to recharge the battery 216. In another embodiment the quiver 200 is connected to the laser bow 100 via a power cable, such as a USB, so that the battery 216 in the quiver 200 powers the laser bow 100 or the battery 138 in the laser bow 100 powers the quiver 200. The quiver 200 has a printed circuit board 220 which controls the functionality of the quiver 200. The quiver 200 has an antenna 228 to permit the quiver 200 to communicate with a remote computer, a server, other game components such as the laser bow 100, other player's guns, bows, or quivers, a cellular device, a wireless network, a LAN, or any other communication network or device.

Figure 10:
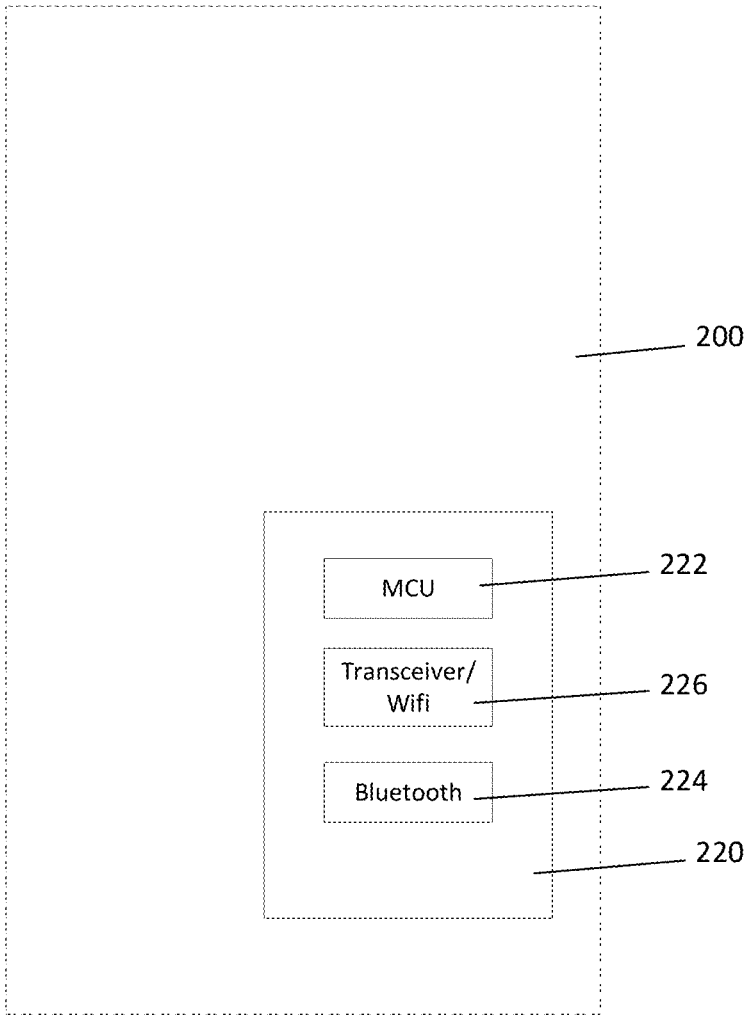
FIG. 10 is a schematic of the electronic board of the quiver for the laser bow.

Referring to FIG. 10, the printed circuit board 220 of the quiver 200 is displayed. The printed circuit board 220 may have any number of components or circuits and may store data and executable instructions. In the preferred embodiment, the printed circuit board 220 has a microprocessor 222, a transceiver 226, and a Bluetooth transmitter 224. The microprocessor 222 is configured to execute instructions and control the total electronic operations of the quiver 200. The transceiver 226 permits the quiver 200 to communicate with other devices. The transceiver 226 can operate via a WiFi signal, Near Field Communication, or any other communication means. The Bluetooth transmitter 224 permits the quiver 200 to communicate with any other Bluetooth enabled device, such as a cellular phone.

Figure 11:
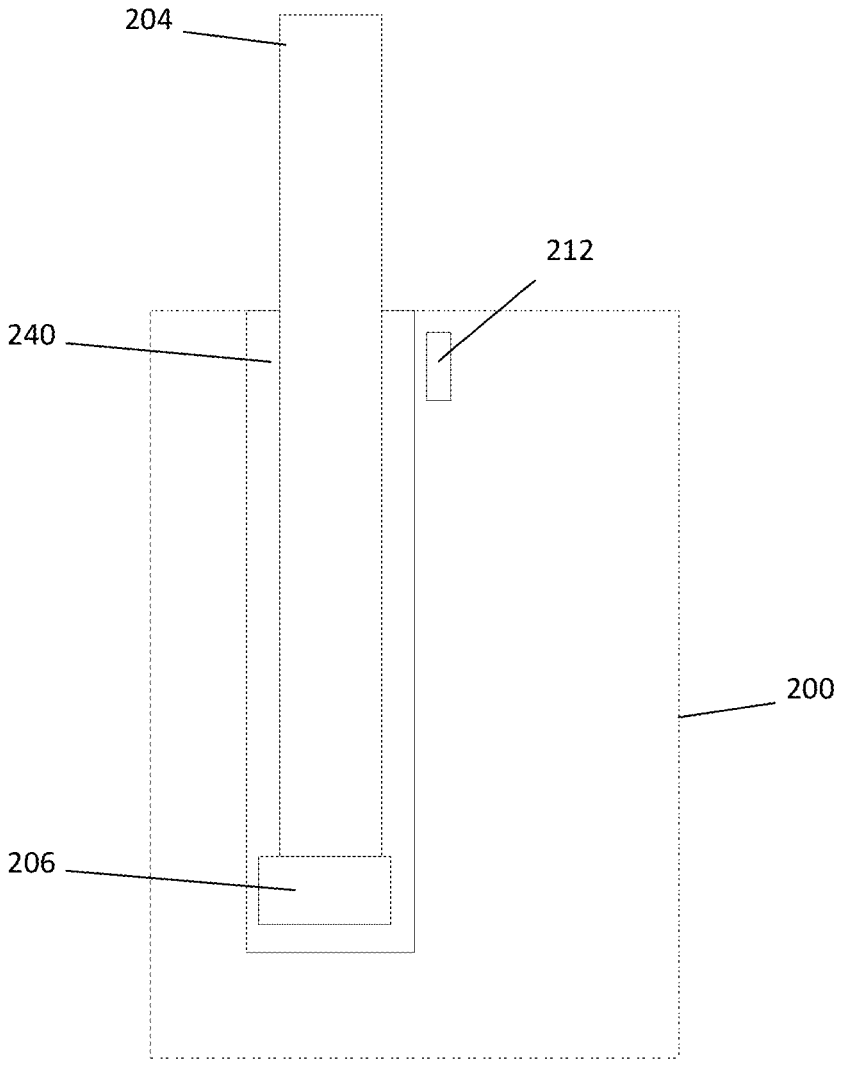
FIG. 11 is a side view of a quiver for the laser bow.

Referring to FIG. 11, the preferred embodiment of the operation of the quiver 200 is displayed. In this embodiment the reload lever 204 is disposed in an internal cavity 240. The reload lever 204 can be pulled in and out of the internal cavity 240. At the bottom end of the reload lever 204 is a magnet 206. Toward the top end of the internal cavity 240 is a magnetic sensor 212. As the magnet 206 on the reload lever 204 engages the magnetic sensor 212. When the magnetic sensor 212 is activated by the magnet 206, the magnetic sensor 212 sends a signal to the laser bow 100. When the laser bow 100 receives the signal that the magnetic sensor 212 has been activated, the laser bow 100 reloads the number of shots that the player can take with the laser bow 100.

Figure 12:
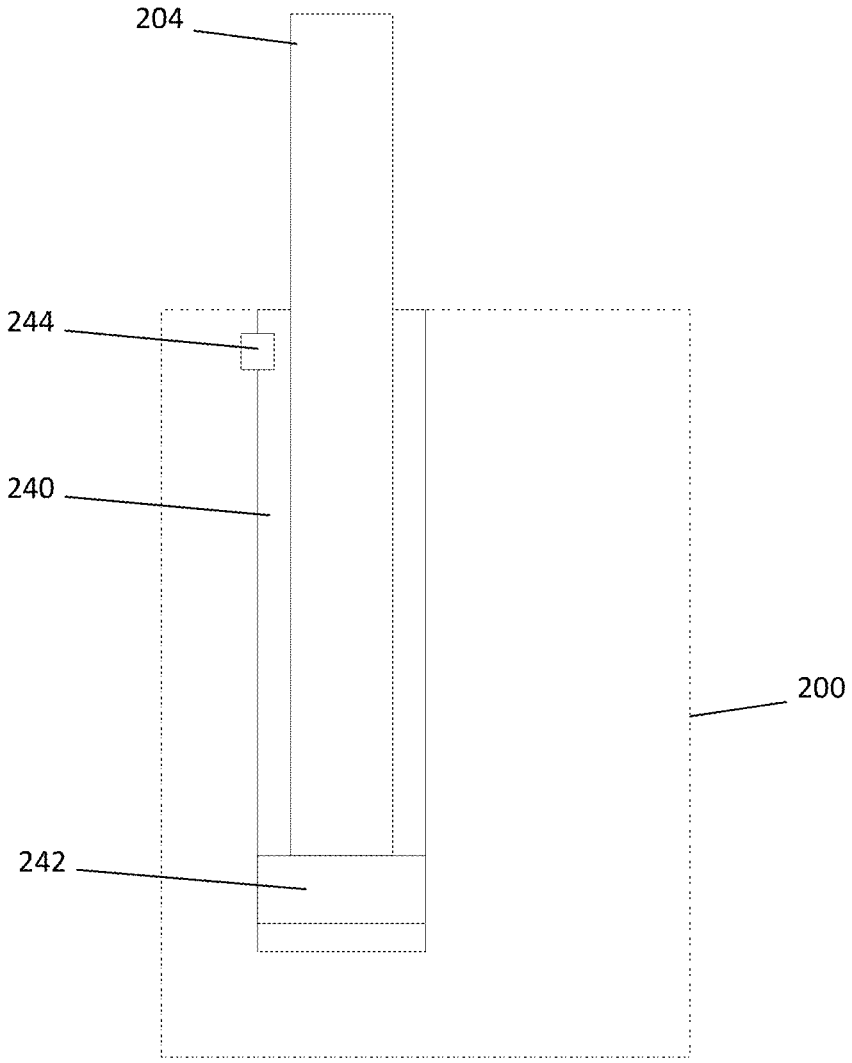
FIG. 12 is a side view of an alternative embodiment of the quiver for the laser bow.

Referring to FIG. 12, an alternative embodiment of the quiver 200 is displayed. In this embodiment the reload lever 204 has a flange 242 disposed at the lower end of the reload lever 204. When a user pulls up on the reload lever 204, the flange 242 engages a reload button 244 disposed in the internal cavity 240. When the reload button 244 is pressed by the flange 242 of the reload lever 204, the quiver 200 sends a reload signal to the laser bow 100. When the laser bow 100 receives the signal that the reload button 244 has been pressed, the laser bow 100 reloads the number of shots that the player can take with the laser bow 100.

Figure 13:
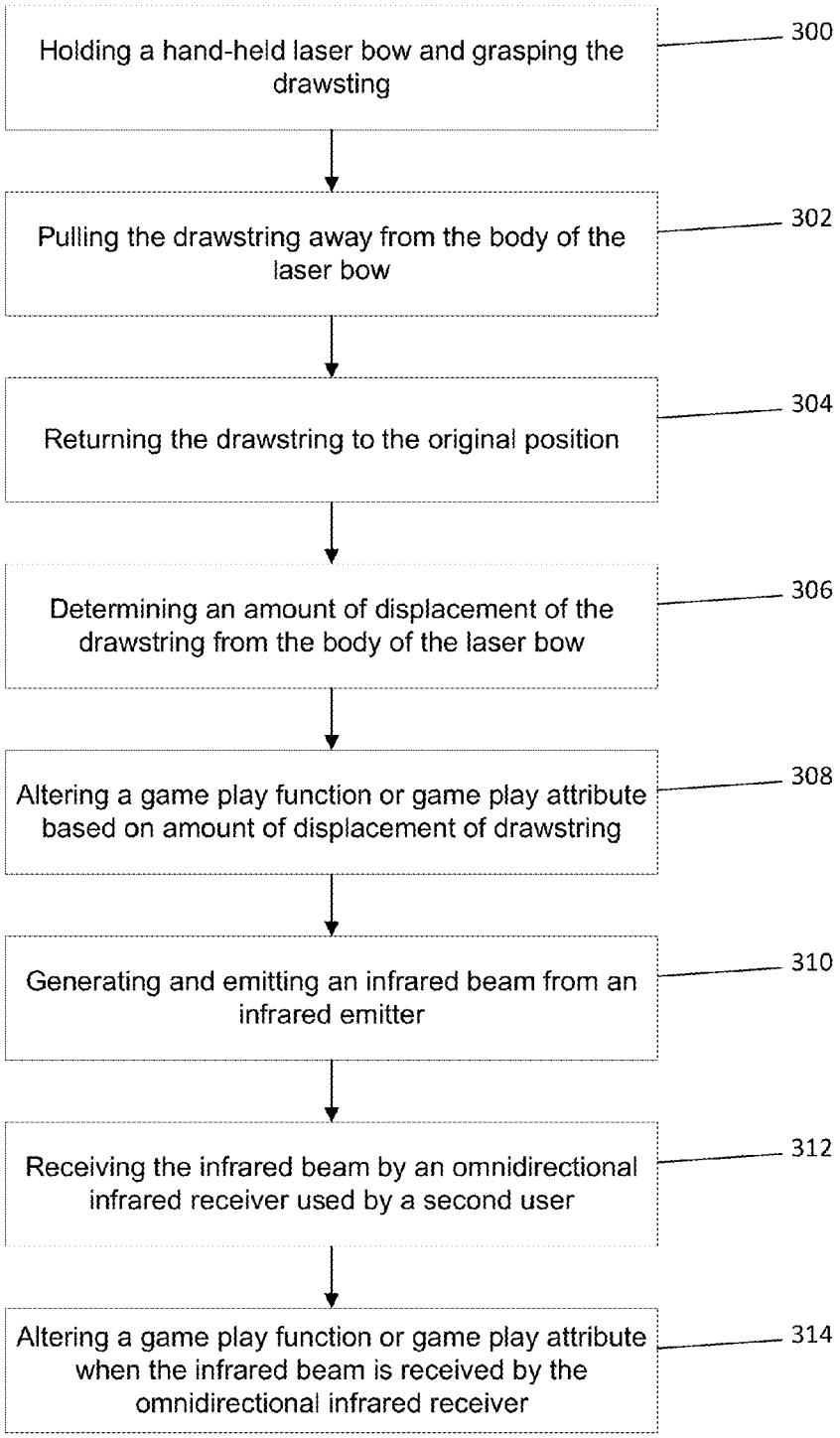
FIG. 13 is a schematic illustrating the use of the laser bow.

Referring to FIG. 13, a method of utilizing the laser bow 100 is illustrated. First a user holds a hand-held laser bow and grasps the drawstring 300. The user then pulls the drawstring away from the body of the laser bow 302. The user then returns the drawstring to the original position 304. The user may return the drawstring slowly or may quickly let go of the drawstring so it quickly snaps back to the original position. The laser bow may determine the amount of displacement of the drawstring from the body of the laser bow 306. The laser bow may alter a game play function or game play attribute based on the amount of displacement of the drawstring 308.

A game play function is a function or operation of the laser bow or other gaming device while in a game. For instance, the laser bow may alter the type of weapon or type of damage done by the laser bow based on the amount of displacement. For instance if a user only pulls the drawstring a small amount to a first position the laser bow may shoot a power up to a player on the same team (e.g. health medkit, damage increase, invincibility) or interference to a player on the opposing team (e.g. decrease damage done by opposing player's gun or laser bow, slow shooting rate of opposing player's gun or laser bow, EMP pulse temporarily disabling opposing player's gun or laser bow). Then if the user increases the amount of displacement to a second position then the laser bow returns to a damaging shot which decreases the health of the opposing player who is hit. A game play attribute is any type of attribute within the game that is not functional, such as a player's health points within a game or the damage done by the laser bow to an opposing player hit by the infrared beam emitted. For instance, without limitation, the laser bow may determine that the laser bow does more damage to a player hit by the laser bow when the drawstring has a greater displacement. Also, the amount of displacement may be utilized to alter the health of the user operating the laser bow in the game. For instance, as the user draws the drawstring back the laser bow will do damage to opposing players. However, if the user draws the drawstring to a maximum displacement the laser bow does not emit an infrared beam but instead uses a health medkit to increase the user's health points in the game.

After determining a displacement and release of the drawstring, the laser bow generates and emits an infrared beam 310. The infrared beam is then received by an omnidirectional infrared receiver used by a second user 312. Alternatively, a game play function or game play attribute may be altered when the infrared beam is received by the omnidirectional infrared receiver 314. In the preferred embodiment a game play function or attribute of the player whose omnidirectional infrared receiver receives the infrared beam is altered (e.g. that player's health is decreased, that player does less damage in the game). Alternatively, a game play attribute or function of the person shooting the laser bow is altered when the omnidirectional infrared receiver receives the infrared beam (e.g. hit player causes a splash which does a small percentage of damage to the shooter).

Figure 14:
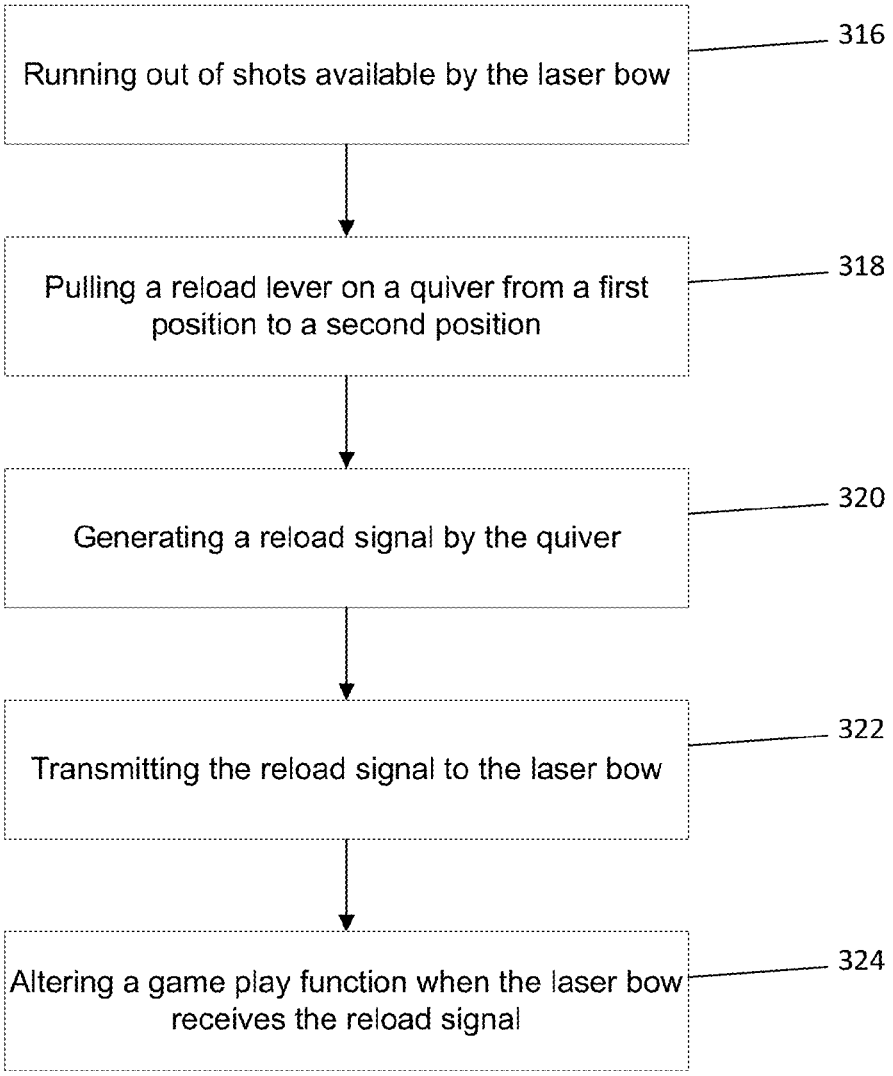
FIG. 14 is a schematic illustrating the use of the laser bow.

Referring to FIG. 14, the method of the game play is further illustrated. In the preferred embodiment the laser bow has a finite number of shots permitted. The user runs out of shots available by the laser bow 316. The user then pulls on the reload lever which is in the quiver from a first position to a second position 318. The alteration of positions may be in any direction and form. For instance the reload lever may be pulled longitudinally so it slides along its length to simulate pulling an arrow from a quiver. Alternatively, the reload lever may be operated as a switch so the reload lever is moved from side to side. When the reload lever changes positions, the quiver generates a reload signal 320. The quiver then transmits the reload signal to the laser bow 322. The laser bow then alters a game play function when the laser bow receives the reload signal 324. Preferably, the reload signal reloads the number of shots available to the user of the laser bow. Thus when the finite number of shots is first used up, the laser bow will cease to emit infrared beams until the reload signal is received from the quiver. Alternatively, the reload signal from the quiver may be utilized to enhance the damage done by the laser bow—for instance simulating an explosive tipped arrow in gameplay. The quiver may have multiple reload levers where each reload lever is a different type of simulated arrow in game play (e.g. the player pulls on a first reload lever to shoot standard arrows but pulls on a second reload lever to shoot an explosive tipped arrow which does more damage to other players but is not available as often).

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The hardware used to implement the various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, some steps or methods may be performed by circuitry that is specific to a given function.

In one or more exemplary aspects, the functions described may be implemented in hardware, software, firmware, or any combination thereof. If implemented in software, the functions may be stored on or transmitted over as one or more instructions or code on a computer-readable medium. The steps of a method or algorithm disclosed herein may be embodied in a processor-executable software module, which may reside on a tangible, non-transitory computer-readable storage medium. Tangible, non-transitory computer-readable storage media may be any available media that may be accessed by a computer. By way of example, and not limitation, such non-transitory computer-readable media may comprise RAM, ROM, EEPROM, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of non-transitory computer-readable media. Additionally, the operations of a method or algorithm may reside as one or any combination or set of codes and/or instructions on a tangible, non-transitory machine readable medium and/or computer-readable medium, which may be incorporated into a computer program product.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A gaming device for use in a laser tag game comprising
a) a bow shaped body having a first arm and a second arm;
b) a string having a first end coupled to said first arm and a second end coupled to said second arm;
c) an infrared emitter coupled to said bow shaped body;
d) wherein said infrared emitter is configured to generate an infrared beam when said string is pulled away from said bow shaped body and returned to its original static position; and
e) a quiver communicatively coupled to said gaming device, said quiver comprising one or more reload levers, wherein said quiver is configured to send a reload signal to said gaming device when said reload lever is pulled.

2. The gaming device as in claim 1 further comprising one or more omnidirectional infrared receivers.

3. The gaming device as in claim 1 further comprising one or more flex sensors disposed in said first arm and/or said second arm.

4. The gaming device as in claim 3 further comprising
a) one or more omnidirectional infrared receivers;
b) one or more microprocessors;
c) one or more wireless transceivers;
d) one or more lights; and
e) one or more vibration motors.

5. The gaming device as in claim 4 further comprising
a) a battery;
b) a charging port disposed in said bow shaped body;
c) one or more display screens;
d) one or more speakers; and
e) one or more control buttons configured to adjust the operation of the gaming device when pressed.

6. The gaming device as in claim 5 further comprising
a) a tube having a length with a first end, a second end, and a longitudinal axis;
b) wherein said longitudinal axis of said tube is perpendicular to said string; and
c) wherein said first end of said tube is connected to said infrared emitter.

7. The gaming device as in claim 6 wherein said quiver further comprises
a) one or more straps;
b) one or more lights;
c) a battery;
d) a charging port;
e) one or more microprocessors; and
f) one or more transceivers.

8. The gaming device as in claim 1 further comprising one or more lights.

9. The gaming device as in claim 1 further comprising one or more speakers.

10. The gaming device as in claim 1 further comprising one or more vibration motors.

11. The gaming device as in claim 1 further comprising
a) a battery; and
b) a charging port disposed in said bow shaped body.

12. The gaming device as in claim 1 further comprising
a) one or more trigger buttons configured to signal the infrared emitter to generate an infrared beam when pressed; and
b) one or more control buttons configured to adjust the operation of the gaming device when pressed.

13. The gaming device as in claim 1 further comprising one or more display screens.

14. The gaming device as in claim 1 further comprising
a) one or more microprocessors; and
b) one or more wireless transceivers.

15. The gaming device as in claim 1 further comprising
a) a tube having a length with a first end, a second end, and a longitudinal axis;
b) wherein said longitudinal axis of said tube is perpendicular to said string; and c) wherein said first end of said tube is connected to said infrared emitter.

16. The gaming device as in claim 15 wherein said tube has an internal cavity said gaming device further comprising a) a slide disposed within said internal cavity of said tube;

b) an internal trigger button disposed within said internal cavity of said tube; and c) wherein said internal trigger button is configured to signal said infrared emitter to generate an infrared beam when activated by said slide.

17. The gaming device as in claim 16 further comprising a) one or more omnidirectional infrared receivers;

b) one or more microprocessors;

c) one or more wireless transceivers;

d) one or more lights; and e) one or more vibration motors.

18. The gaming device as in claim 17 further comprising a) a battery;

b) a charging port disposed in said bow shaped body;

c) one or more display screens;

d) one or more speakers; and e) one or more control buttons configured to adjust the operation of the gaming device when pressed.

19. The gaming device as in claim 18 further comprising a) a tube having a length with a first end, a second end, and a longitudinal axis;

b) wherein said longitudinal axis of said tube is perpendicular to said string; and c) wherein said first end of said tube is connected to said infrared emitter.

20. The gaming device as in claim 19 wherein said quiver further comprises a) one or more straps;

b) one or more lights;

c) a battery;

d) a charging port;

e) one or more microprocessors; and f) one or more transceivers.

21. The gaming device as in claim 15 wherein said tube has an internal cavity said gaming device further comprising a) a slide containing one or more magnets disposed within said internal cavity of said tube;

b) one or more internal magnetic sensors disposed within said internal cavity of said tube; and c) wherein said magnetic sensors are configured to signal said infrared emitter to generate an infrared beam when activated by said magnets in said slide.

22. The gaming device as in claim 21 further comprising a) one or more omnidirectional infrared receivers;

b) one or more microprocessors;

c) one or more wireless transceivers;

d) one or more lights; and e) one or more vibration motors.

23. The gaming device as in claim 22 further comprising a) a battery;

b) a charging port disposed in said bow shaped body;

c) one or more display screens;

d) one or more speakers; and e) one or more control buttons configured to adjust the operation of the gaming device when pressed.

24. The gaming device as in claim 23 further comprising a) a tube having a length with a first end, a second end, and a longitudinal axis;

b) wherein said longitudinal axis of said tube is perpendicular to said string; and c) wherein said first end of said tube is connected to said infrared emitter.

25. The gaming device as in claim 24 wherein said quiver further comprises a) one or more straps;

b) one or more lights;

c) a battery;

d) a charging port;

e) one or more microprocessors; and f) one or more transceivers.

26. The gaming device as in claim 1 wherein said infrared emitter comprises a lens and an infrared LED.

27. The gaming device as in claim 1 further comprising a finger guide disposed on said string.

28. The gaming device as in claim 1 wherein said quiver further comprises a) one or more straps;

b) one or more lights;

c) a battery;

d) a charging port;

e) one or more microprocessors; and f) one or more transceivers.

29. The gaming device as in claim 1 wherein said quiver further comprises a) an internal cavity, wherein said reload lever is disposed in said internal cavity;

b) a magnetic sensor disposed adjacent to said internal cavity; and c) wherein said reload lever further comprises a magnet.

30. The gaming device as in claim 1 wherein said quiver further comprises a) an internal cavity, wherein said reload lever is disposed in said internal cavity;

b) a reload button disposed in said internal cavity; and c) wherein said reload lever further comprises a flange.

31. The gaming device as in claim 1 wherein said quiver further comprises one or more omnidirectional infrared receivers.

32. The gaming device as in claim 1 further comprising one or more piezoelectric sensors disposed on said first arm and/or said second arm.

33. The gaming device as in claim 32 further comprising a) one or more omnidirectional infrared receivers;

b) one or more microprocessors;

c) one or more wireless transceivers;

d) one or more lights; and e) one or more vibration motors.

34. The gaming device as in claim 33 further comprising a) a battery;

b) a charging port disposed in said bow shaped body;

c) one or more display screens;

d) one or more speakers; and e) one or more control buttons configured to adjust the operation of the gaming device when pressed.

35. The gaming device as in claim 34 further comprising a) a tube having a length with a first end, a second end, and a longitudinal axis;

b) wherein said longitudinal axis of said tube is perpendicular to said string; and c) wherein said first end of said tube is connected to said infrared emitter.

36. The gaming device as in claim 35 wherein said quiver further comprises a) one or more straps;

b) one or more lights;

c) a battery;

d) a charging port;

e) one or more microprocessors; and f) one or more transceivers.

37. The gaming device as in claim 1 further comprising
a) a first wheel rotably connected to an end of said first arm;
b) a second wheel rotably connected to an end of said second arm;
c) wherein said string is coupled to said first wheel and said second wheel; and
d) wherein said first wheel and said second wheel are configured to signal said infrared emitter to generate an infrared beam when rotated by said string.

38. The gaming device as in claim 37 further comprising
a) one or more omnidirectional infrared receivers;
b) one or more microprocessors;
c) one or more wireless transceivers;
d) one or more lights; and
e) one or more vibration motors.

39. The gaming device as in claim 38 further comprising
a) a battery;
b) a charging port disposed in said bow shaped body;
c) one or more display screens;
d) one or more speakers; and
e) one or more control buttons configured to adjust the operation of the gaming device when pressed.

40. The gaming device as in claim 39 further comprising
a) a tube having a length with a first end, a second end, and a longitudinal axis;
b) wherein said longitudinal axis of said tube is perpendicular to said string; and
c) wherein said first end of said tube is connected to said infrared emitter.

41. The gaming device as in claim 40 wherein said quiver further comprises
a) one or more straps;
b) one or more lights;
c) a battery;
d) a charging port;
e) one or more microprocessors; and
f) one or more transceivers.

42. A gaming device for use in a laser tag game comprising
a) a bow shaped body having a first arm and a second arm;
b) a string having a first end coupled to said first arm and a second end coupled to said second arm;
c) an infrared emitter coupled to said bow shaped body;
d) a means for generating an infrared beam from said infrared emitter when said string is pulled away from said bow shaped body and returned to its original static position; and
e) a quiver communicatively coupled to said gaming device, said quiver comprising one or more reload levers and a means for generating and sending a reload signal to said gaming device when pulled.

43. The gaming device as in claim 42 wherein said quiver further comprises
a) one or more straps;
b) one or more lights;
c) a battery;
d) a charging port;
e) one or more microprocessors; and
f) one or more transceivers.

44. The gaming device as in claim 42 further comprising
a) one or more omnidirectional infrared receivers;
b) one or more microprocessors;
c) one or more wireless transceivers;
d) one or more lights; and
e) one or more vibration motors.

45. The gaming device as in claim 44 further comprising
a) a battery;
b) a charging port disposed in said bow shaped body;
c) one or more display screens;
d) one or more speakers; and
e) one or more control buttons configured to adjust the operation of the gaming device when pressed.

46. The gaming device as in claim 45 further comprising
a) a tube having a length with a first end, a second end, and a longitudinal axis;
b) wherein said longitudinal axis of said tube is perpendicular to said string; and
c) wherein said first end of said tube is connected to said infrared emitter.

47. The gaming device as in claim 46 wherein said quiver further comprises
a) one or more straps;
b) one or more lights;
c) a battery;
d) a charging port;
e) one or more microprocessors; and
f) one or more transceivers.

48. A method for playing a laser tag game comprising
a) holding a hand-held gaming device
i) wherein said hand-held gaming device comprises a bow shaped body having a first arm and a second arm, a string having a first end coupled to said first arm and a second end coupled to said second arm, an infrared emitter coupled to said bow shaped body, and a means for generating an infrared beam from said infrared emitter when said string is pulled away from said bow shaped body and returned to its original static position, and a quiver communicatively coupled to said gaming device, said quiver comprising one or more reload levers and a means for generating and sending a reload signal to said gaming device when pulled;
b) grasping said string in a first static position where said string is disposed adjacent to said bow shaped body;
c) pulling a portion of said string away from said first static position to a second position where said portion of said string is disposed further away from said bow shaped body than when in said first static position;
d) returning said string to said first static position; and
e) generating and emitting an infrared beam from said infrared emitter.

49. The method as in claim 48 further comprising
a) pulling said reload lever from a first static position to a second position;
b) generating, by said quiver, a reload signal;
c) transmitting said reload signal to said hand-held gaming device; and
d) altering a game play function when said hand-held gaming device receives said reload signal.

50. The method as in claim 49 further comprising
a) determining an amount of displacement of said portion of string from said first static position to said second position; and
b) altering a game play function based on said amount of displacement of said portion of string.

51. The method as in claim 50 further comprising receiving said infrared beam by an omnidirectional infrared receiver utilized by a second player.

52. The method as in claim 51 further comprising altering a game attribute when said infrared beam is received by said omnidirectional receiver utilized by a second player.

53. The method as in claim 52 further comprising altering a game play function when said infrared beam is received by said omnidirectional receiver utilized by a second player.

54. The method as in claim 48 further comprising a) determining an amount of displacement of said portion of string from said first static position to said second position; and b) altering a game play function based on said amount of displacement of said portion of string.

55. The method as in claim 48 further comprising receiving said infrared beam by an omnidirectional infrared receiver utilized by a second player.

56. The method as in claim 55 further comprising altering a game play function when said infrared beam is received by said omnidirectional receiver utilized by a second player.

57. The method as in claim 55 further comprising altering a game attribute when said infrared beam is received by said omnidirectional receiver utilized by a second player.

* * * * *